US008468946B2

(12) United States Patent
Van Stratum et al.

(10) Patent No.: US 8,468,946 B2
(45) Date of Patent: Jun. 25, 2013

(54) LOW SHRAPNEL DOOR BREACHING PROJECTILE SYSTEM

(75) Inventors: Bruce G. Van Stratum, Talla Hassee, FL (US); James P. Muncie, Tallahassee, FL (US); Matthew E. Eckel, Perry, FL (US)

(73) Assignee: Chemring Ordnance, Inc., Perry, FL (US)

( * ) Notice: Subject to any disclaimer, the term of this patent is extended or adjusted under 35 U.S.C. 154(b) by 0 days.

(21) Appl. No.: 13/070,984

(22) Filed: Mar. 24, 2011

(65) Prior Publication Data

US 2012/0216698 A1 Aug. 30, 2012

Related U.S. Application Data

(63) Continuation-in-part of application No. 12/657,405, filed on Jan. 19, 2010.

(51) Int. Cl.
*F42B 30/04* (2006.01)

(52) U.S. Cl.
USPC ..... 102/477; 102/488

(58) Field of Classification Search
USPC ..... 102/271–275, 275.9, 368, 370, 488, 102/477, 231, 266, 262, 270, 236, 216
See application file for complete search history.

(56) References Cited

U.S. PATENT DOCUMENTS

| | | | | |
|---|---|---|---|---|
| 1,374,705 | A * | 4/1921 | Wright | 102/216 |
| 1,385,610 | A * | 7/1921 | Flam | 102/272 |
| 2,368,310 | A * | 1/1945 | Lecky et al. | 102/205 |
| 3,922,967 | A * | 12/1975 | Mertens | 102/439 |
| 6,035,783 | A * | 3/2000 | Cho | 102/235 |
| 2008/0006171 | A1 * | 1/2008 | Confer | 102/497 |

* cited by examiner

*Primary Examiner* — Michael Carone
*Assistant Examiner* — Reginald Tillman, Jr.
(74) *Attorney, Agent, or Firm* — J. Wiley Horton

(57) ABSTRACT

A modified 40 mm grenade round designed to breach doors without throwing a significant amount of shrapnel into a building's interior or back toward the shooter. The modified round includes a forward extension on the ogive. The extension is rigidly connected to a thrust column which transmits an impact load directly from the ogive's nose cap to the striker on the fuse assembly. This configuration detonates the explosive charge within the projectile while the explosive is still well outside the door. This early detonation throws a pressure wave again the door's exterior, forcing the door inward.

18 Claims, 17 Drawing Sheets

LOW SHRAPNEL DOOR BREACHING PROJECTILE SYSTEM

CROSS-REFERENCES TO RELATED APPLICATIONS

This application is a continuation-in-part of U.S. application Ser. No. 12/657,405. The parent application was filed on Jan. 19, 2010. It lists the same inventor and remains pending as of the date of filing of the present application.

STATEMENT REGARDING FEDERALLY SPONSORED RESEARCH OR DEVELOPMENT

Not Applicable.

MICROFICHE APPENDIX

Not Applicable

BACKGROUND OF THE INVENTION

1. Field of the Invention

This invention relates to the field of projectile delivery systems. More specifically, the invention comprises an explosive projectile designed to breach a door while producing very little shrapnel.

2. Description of the Related Art

Although the components of the present invention can be applied to many different types of projectiles, they were primarily developed as a component of existing 40 mm grenade weapons (such as the U.S. Army's M-433). While those skilled in the art will be familiar with such weapons, a brief description may nevertheless be helpful.

FIG. 1 depicts prior art 40 mm grenade round 10. Its two main components are case 12 (which houses the propulsion system) and projectile 14. The grenade round is designed to be fired from a variety of weapons. One example is the U.S. Army's M-203 grenade launcher which is typically slung beneath the barrel of a rifle such as the M-16A2.

The launching of a 40 mm grenade involves the same principles as a conventional rifle cartridge. The main difference, however, is the size and mass of the projectile. A typical shoulder-fired military weapon launches a projectile weighing less than 30 grams at a relatively high velocity (700-1,000 meters per second). In contrast, a 40 mm grenade weapon launches a projectile weighing over 200 grams at a relatively low velocity (70-80 meters per second). Thus, while the operating principles between the two types of weapons are the same, they can be said to operate in different regimes.

The unified 40 mm grenade round 10 is placed in the launching weapon and then fired. Case 12 remains within the weapon. Projectile 14 is propelled down the weapon's bore. Rifling ring 26 engages internal rifling on the firing weapon's bore and spins the projectile in order to stabilize it in flight.

The leading end of the projectile assumes the form of ogive 28. Those skilled in the art will know that the term "ogive" sometime refers to a specific profile used for missile nose cones. However, the term is also more broadly used to mean the nose portion of any flying projectile. In this disclosure, "ogive" is given the latter meaning. Thus, it may assume a wide variety of shapes. The ogive generally contains the arming and detonating mechanisms. The volume between the ogive and the rifling ring typically contains the explosive.

FIG. 2 shows the same 40 mm grenade round of FIG. 1 cut in half to reveal its internal details. Projectile 14 includes a hollow volume defined by the combination of ogive 28, casing 36, and aft closure 38. These three components are joined together by suitable means, such as threaded engagements.

Explosive 34 is contained within casing 36. Fuse assembly 30 is contained within ogive. The fuse assembly activates spitback detonator 32 when the projectile strikes a target object (assuming it has been appropriately armed). The spitback detonator then initiates explosive 34. Casing 36 is typically scored to form a series of rectangles which will break into relatively small pieces when the explosive detonates.

The propulsion system contained within case 12 is often referred to as a "high-low" system. While a detailed discussion of this system is beyond the scope of this disclosure, a brief description may aid the reader's understanding of the environment in which the present invention operates. The "high" part of the system refers to high pressure chamber 18. This chamber is often created by the insertion of a metallic case filled with propellant into base 16. The open end of the metallic case is closed by burst diaphragm 22. A primer is contained in the opposite end.

A mechanical striker is used to detonate this primer which then causes the propellant within the high pressure chamber to initiate. This action ruptures the burst diaphragm. The expanding propellant gases are then metered through nozzle 24 into low pressure chamber 20. These relatively low pressure gases act against the aft end of aft closure 38, thereby propelling the projectile down the firing weapon's bore. For a more detailed discussion of the propulsion system of the M-433, the reader may wish to review U.S. Pat. No. 7,004,074 to Van Stratum (2006), which is hereby expressly incorporated by reference.

A detailed description of the fuse assembly is likewise beyond the scope of this disclosure. However, a fuse assembly typically contains a number of safety features designed to prevent accidental detonation. For example, in some embodiments, the fuse can only be armed when the projectile first experiences a violent forward acceleration followed by a rotation at a minimum rotational velocity. The presence of these two cues indicates that the projectile has been intentionally and successfully fired from a weapon. The fuse assembly will then arm itself during flight. Once armed, any sudden deceleration (such as the projectile impacting a surface) will initiate spitback detonator 32 and explode the grenade.

A typical fuse assembly is the M-550 fuse used by the U.S. Army. A discussion of the details of the fuse assembly is beyond the scope of this disclosure. However, the reader wishing to know these details is referred to U.S. Pat. No. 5,081,929 to Mertens (1992).

The assembly shown in FIGS. 1 and 2 functions very well. FIG. 3 shows projectile 14 flying toward a target. FIG. 4 shows the projectile striking a target and detonating. Target surface 42 is in this example a reinforced piece of concrete (a hard target). The explosion throws shrapnel 40 in all directions away from the point of impact. FIG. 5 shows the result, with void 44 being blown into target surface 42. The prior art projectile is primarily intended as an anti-personnel weapon, and the wide dispersal of shrapnel is obviously effective in this regard.

FIG. 6 shows an idealized depiction of the detonation of explosive 34. Explosive pressure is generally emitted in a direction normal to the surface of the volume of explosive. As the explosive volume depicted is cylindrical, it will emit lateral pressure wave 50 (roughly in the shape of an expanding cylinder), forward pressure wave 46, and rearward pressure wave 48. The shape of these pressure waves determine in large part how shrapnel created by the explosion will fly.

It has long been known to use a 40 mm grenade as a door breaching round. However, it is not optimal in this role. In anti-insurgency operations, soldiers must often penetrate occupied buildings. In many instances, it is not known whether the occupants are hostile. However—hostile or not—the occupants will not voluntarily open the door. Thus, the door must be breached.

FIGS. 7 and 8 shows the use of a prior art 40 mm grenade round in this role. In FIG. 7, projectile 14 impacts door 52 at a significant velocity (typically about 70 meters per second). Ogive 28 knocks breach 54 into the face of the door. The sudden deceleration initiates the fuse assembly, so spitback detonator 32 initiates the explosive. FIG. 8 shows the result. The expanding pressure waves from the exploding projectile destroy the door and explosion 58 sends flying debris 56 into the occupied structure. Persons within the structure may be injured or killed.

In addition, debris from the door and the casing of the projectile itself may be thrown back toward the shooter. This fact forces the shooter to stand back a considerable distance (such as 30 meters). It is more desirable to station the soldier or soldiers preparing to enter a structure much closer to the door, so that there will be little delay between the detonation of the grenade and their entry.

Thus, while the prior art 40 mm grenade, round is effective in breaching doors, it may produce unwanted collateral damage and may unduly delay the entry of a security team into a structure. A system which can breach the door without throwing significant shrapnel would therefore be preferable.

BRIEF SUMMARY OF THE INVENTION

The present invention is a modified 40 mm grenade round designed to breach doors without throwing a significant amount of shrapnel into a building's interior or back toward the shooter. The modified round includes a forward extension on the ogive. The extension is rigidly connected to a thrust column which transmits an impact load directly from the ogive's nose cap to the striker on the fuse assembly. This configuration detonates the explosive charge within the projectile while the explosive is still well outside the door. This early detonation throws a pressure wave again the door's exterior, forcing the door inward.

The projectile includes primarily plastic components which fracture into light and small debris when the explosive detonates. The projectile preferably also includes bore-riding cylindrical surfaces in the body and the ogive. These surfaces minimize balloting and resulting off-axis wobble as the projectile exits the muzzle of a weapon.

REFERENCE NUMERALS IN THE DRAWINGS

| | | | |
|---|---|---|---|
| 10 | 40 mm grenade round | 12 | case |
| 13 | propulsion assembly | 14 | projectile |
| 16 | base | 17 | side wall |
| 18 | high pressure chamber | 20 | low pressure chamber |
| 22 | burst diaphragm | 24 | nozzle |
| 26 | rifling ring | 28 | ogive |
| 30 | fuse assembly | 32 | spitback detonator |
| 34 | explosive | 36 | casing |
| 38 | aft closure | 40 | shrapnel |
| 42 | target surface | 44 | void |
| 46 | forward pressure wave | 48 | rearward pressure wave |
| 50 | lateral pressure wave | 52 | door |
| 54 | breach | 56 | flying debris |
| 58 | explosion | 68 | door frame |
| 70 | steel door | 72 | steel bar door |
| 74 | detonation assembly | 76 | body |
| 78 | upper extreme | 80 | lip |
| 82 | cylindrical side wall | 84 | aft closure |
| 86 | aft pocket | 88 | lip receiver |
| 90 | female thread | 92 | bulkhead |
| 94 | detonator pocket | 96 | male thread |
| 98 | hammer weight | 100 | striker |
| 102 | thrust column | 104 | nose cap |
| 106 | sloping side wall | 108 | cylindrical side wall |
| 112 | threaded engagement | 114 | extension |
| 116 | groove engaging protrusion | 118 | standoff ogive |

DETAILED DESCRIPTION OF THE INVENTION

Figure 1:
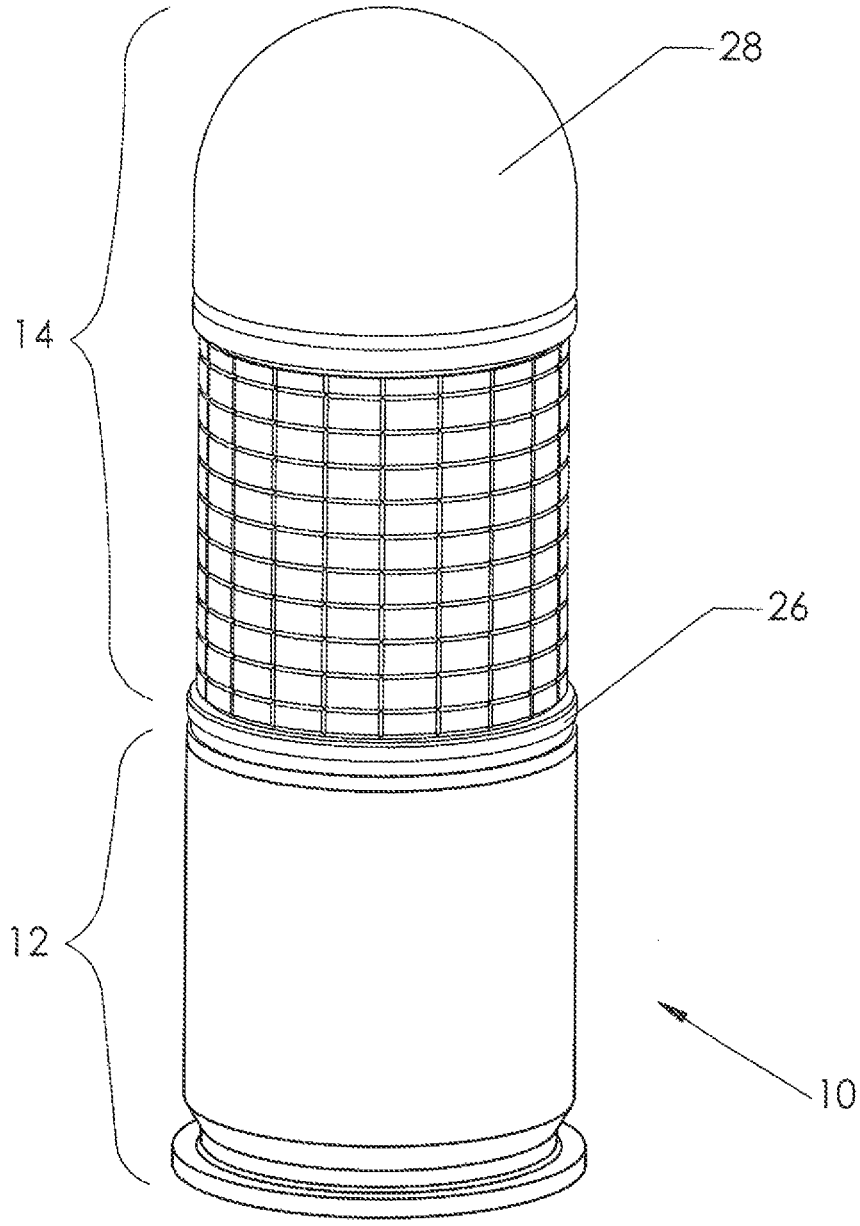
FIG. 1 (PRIOR ART)
FIG. 1 is a perspective view, showing a prior art 40 mm grenade round.
Figure 2:
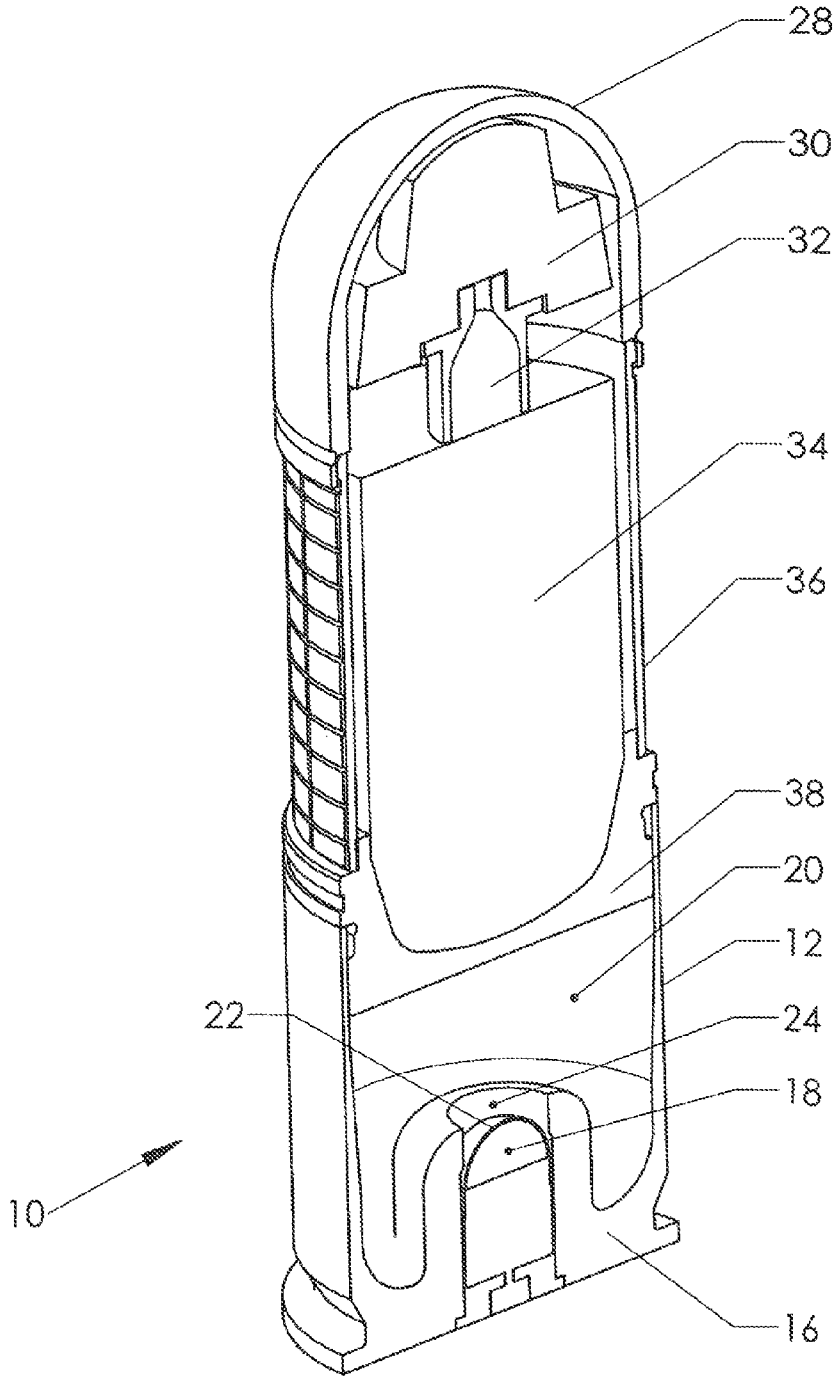
FIG. 2 (PRIOR ART)
FIG. 2 is a perspective view with a cutaway, showing internal details of the prior art grenade round.
Figure 3:
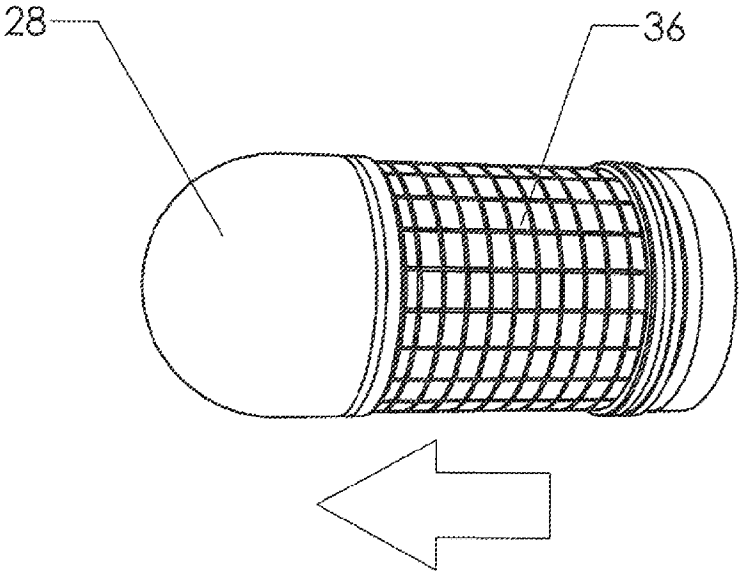
FIG. 3 (PRIOR ART)
FIG. 3 is a perspective view, showing a prior art projectile in flight.
Figure 4:
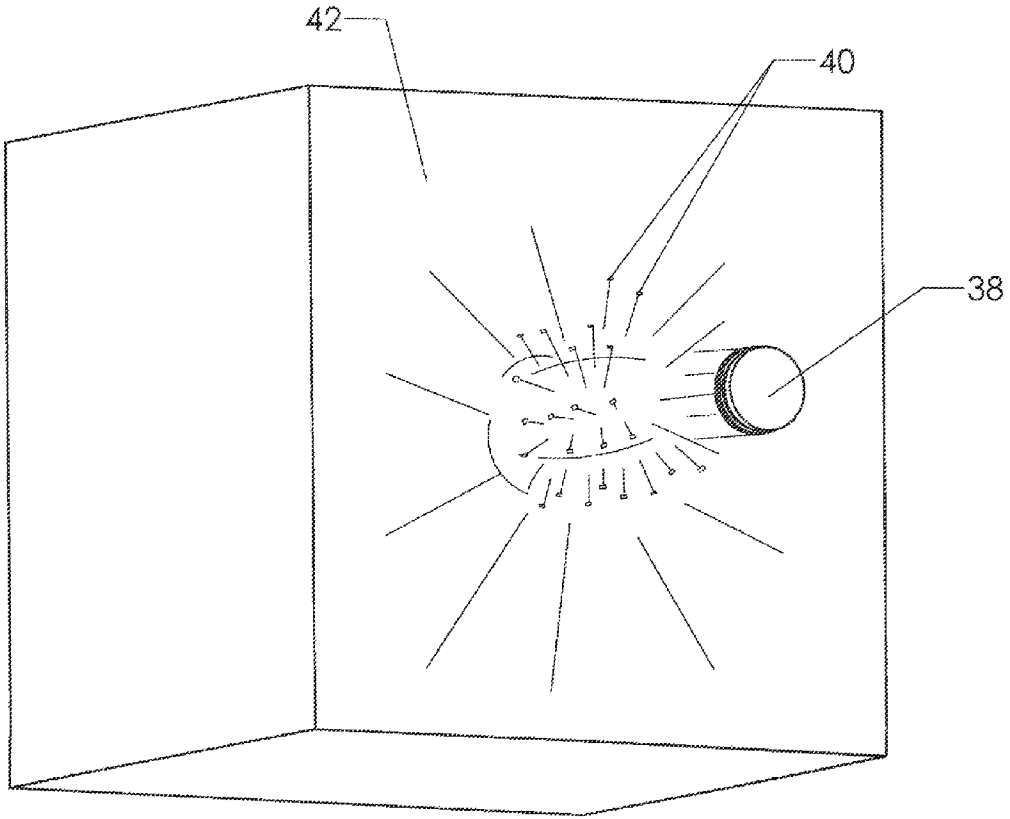
FIG. 4 (PRIOR ART)
FIG. 4 is a perspective view, showing the detonation of the projectile upon striking the target.
Figure 5:
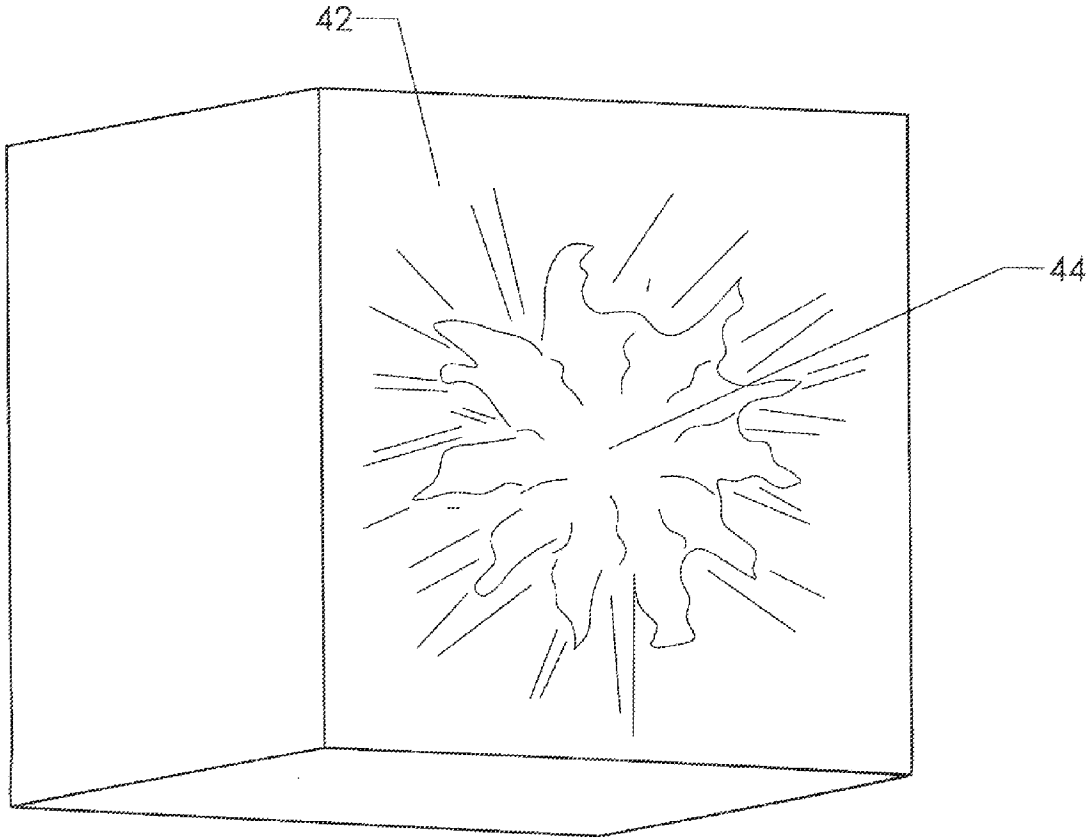
FIG. 5 (PRIOR ART)
FIG. 5 is a perspective view, showing the resulting damage to the target.
Figure 6:
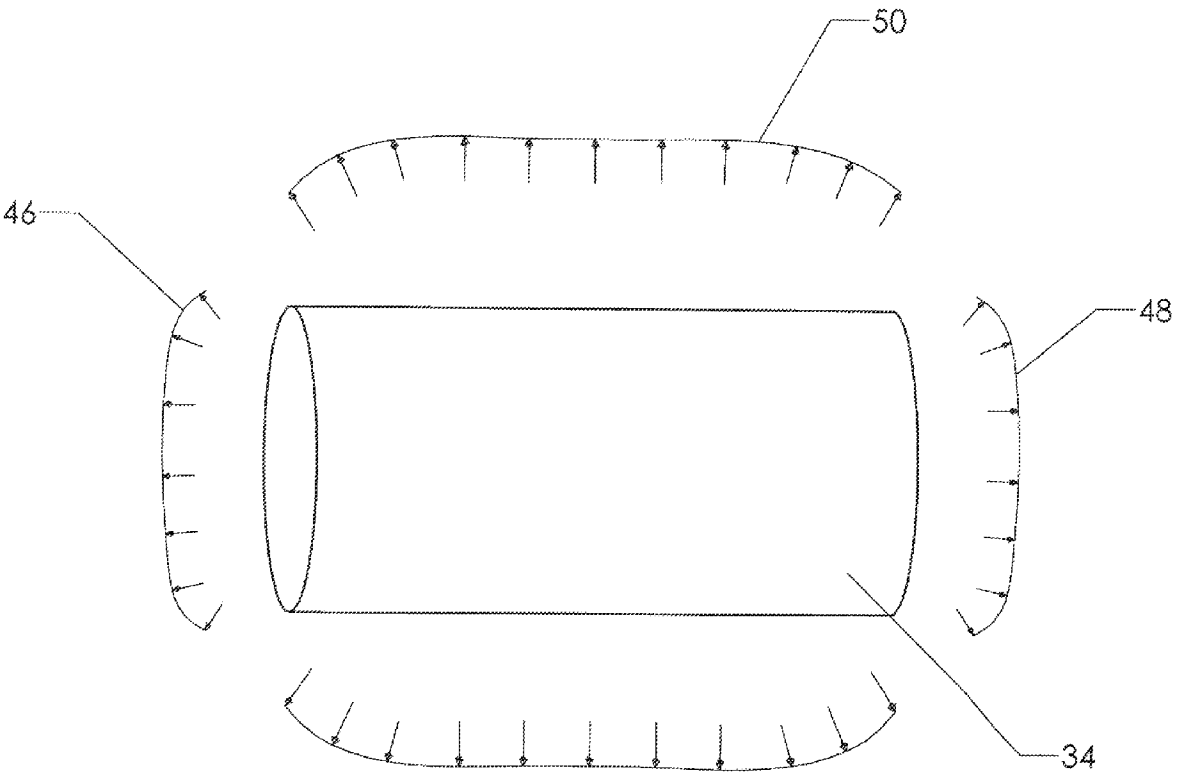
FIG. 6 (PRIOR ART)
FIG. 6 is a perspective view, showing the expanding pressure waves caused by the detonation of a cylindrical volume of explosive material.
Figure 7:
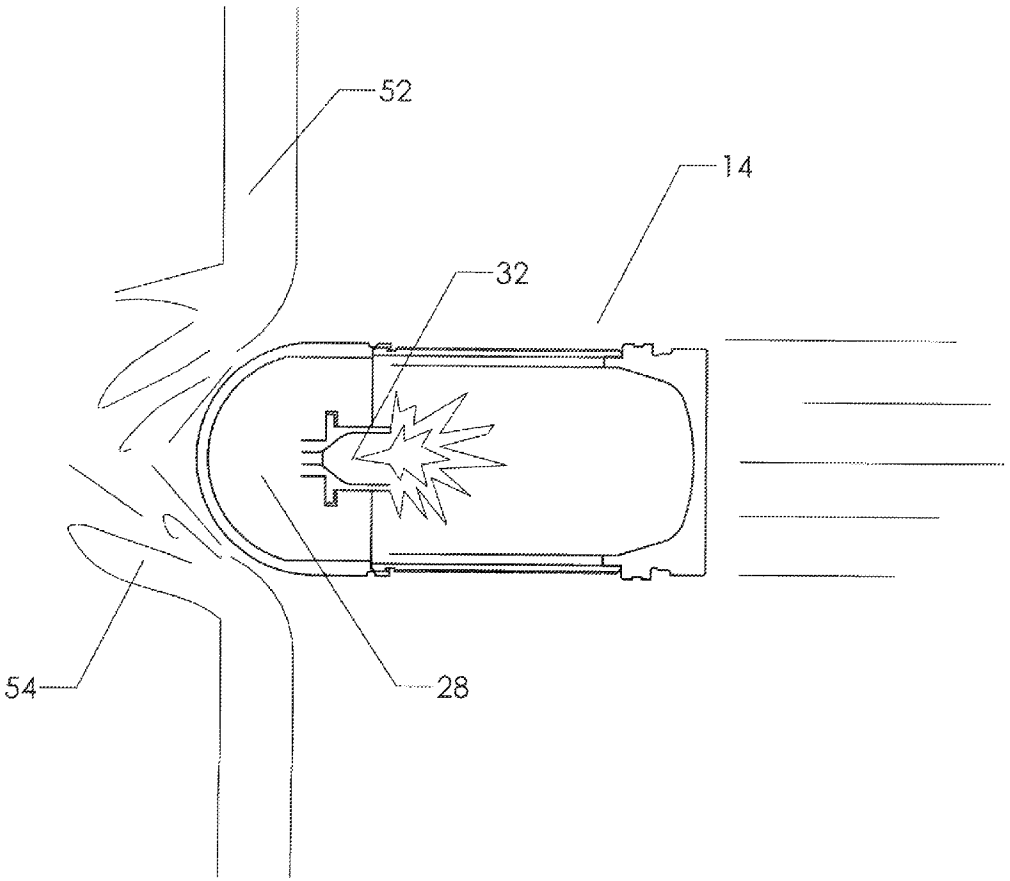
FIG. 7 (PRIOR ART)
FIG. 7 is an elevation view, showing a prior art projectile striking a door.
Figure 8:
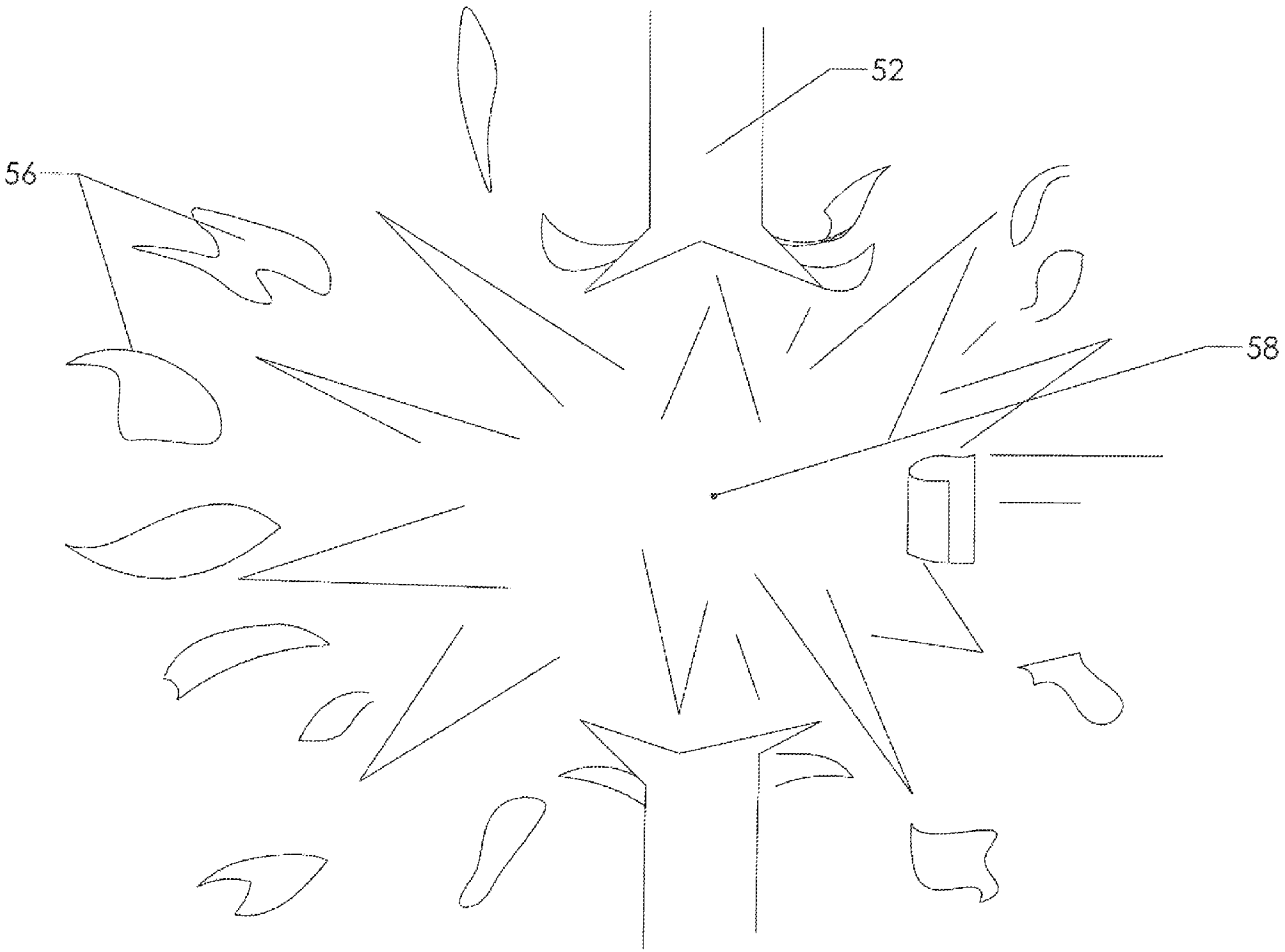
FIG. 8 (PRIOR ART)
FIG. 8 is an elevation view, showing a prior art projectile destroying a door.
Figure 9:
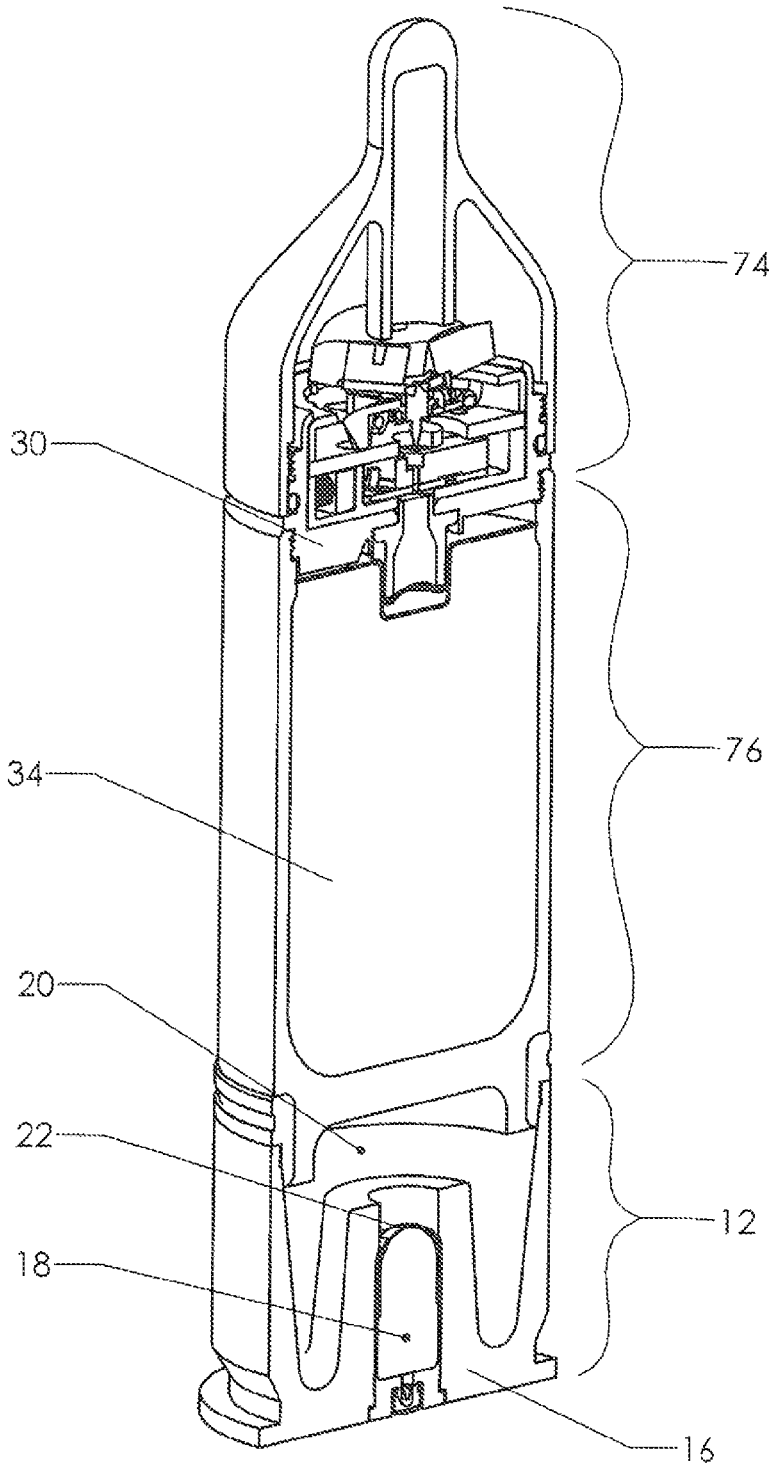
FIG. 9 is an elevation view, showing a projectile made according to the present invention.

FIG. 9 shows a perspective view of a grenade round made according the present invention, including a cutaway to reveal internal details. The round includes three major components. These are: detonation assembly 74, body 76, and propulsion assembly 13.

The round is made to be fired from a rifled bore. Propulsion assembly 13 remains in the breech end of the bore when the round is fired. Detonation assembly 74 and body 76 together form a projectile which flies downrange as a unit. Acceleration of the projectile is accomplished using the same "high-low" pressure system as for the prior art. The propellant within high pressure chamber 18 is initiated. Burst diaphragm 22 then ruptures and meters the expanding propellant gas into low pressure chamber 20 (which is the void between the aft end of body 76 and base 16). Body 76 contains explosive 34. The explosive is initiated by fuse assembly 30, which will be explained in more detail subsequently.

Figure 10:
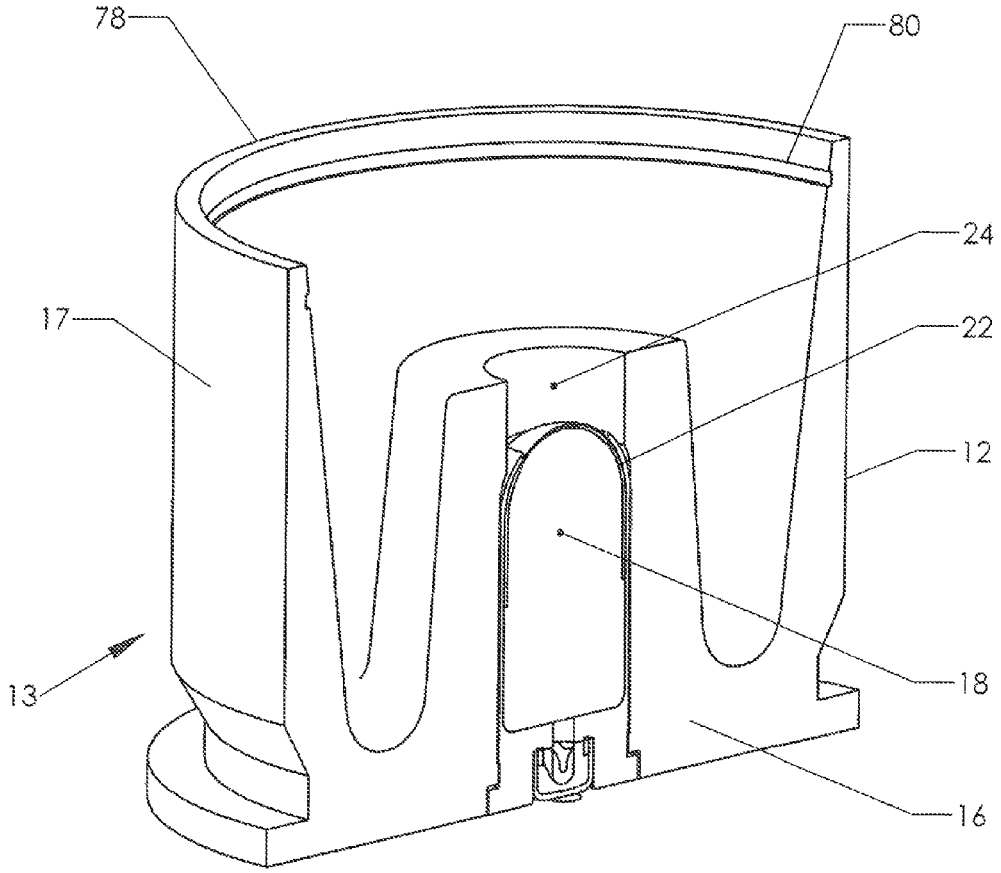
FIG. 10 is a perspective view with a cutaway, showing internal details of the propulsion assembly.

FIG. 10 shows a more detailed view of propulsion assembly 13 (a cutaway is again included to reveal internal features). The reader will observe how expanding gases from high pressure chamber 18 are metered through nozzle 24 into the low pressure chamber. Case 12 includes base 16 joined to side wall 17. Side wall 17 includes a protruding lip 80 proximate upper extreme 78. This lip is configured to engage a corresponding feature on the body so that the propulsion assembly and the body can be attached.

Figure 11:
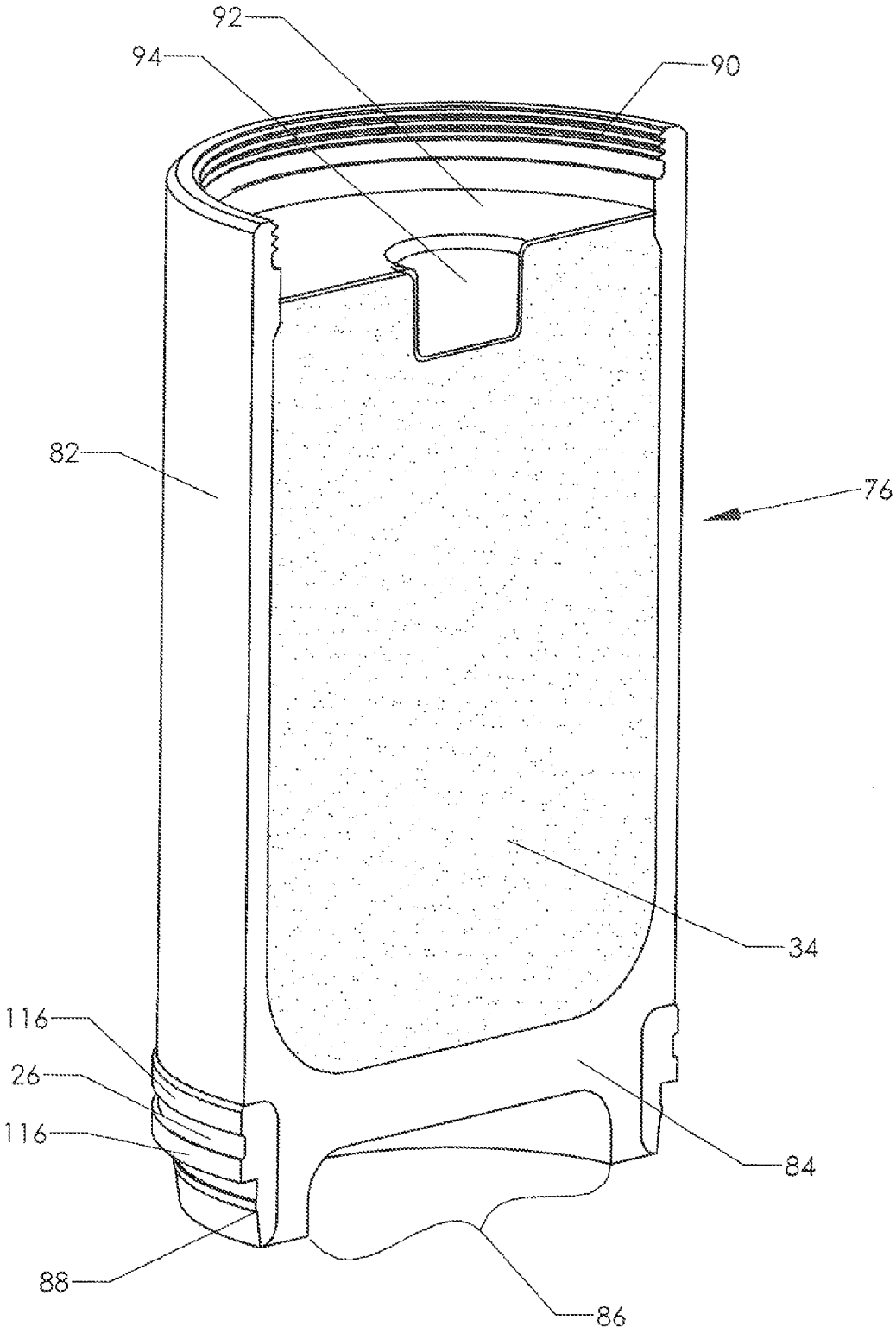
FIG. 11 is a perspective view with a cutaway, showing the body with its contained explosive.

FIG. 11 is a cutaway view of body 76. Aft closure 84 is preferably formed integrally with cylindrical side wall 82. Explosive 34 is contained within this interior volume. The explosive is preferably covered by a thin bulkhead 92. This bulkhead preferably includes detonator pocket 94. The bulkhead covers the forward end of the explosive mass. It provides a moisture seal. It also tends to prevent spalling upon the initiated of the round.

Female thread 90 is provided on the forward portion of cylindrical side wall 82. This feature is used to join the body to detonation assembly 74. Rifling ring 26 is provided on the aft end of body 76. The body may be made from a relatively soft material such as reinforced plastic. The rifling ring is intended to engage the grooves and lands in the firing bore so that the projectile may be rotationally accelerated as it travels down the bore. It is therefore preferable to make the rifling ring out of tougher material—with aluminum being a good choice.

Those skilled in the art will know that a rifled bore is often defined by two distinct diameters. First is the "bore diameter" or "land diameter." Second is the "groove diameter," which is the diameter of a circle passing through the deepest part of the rifling grooves. The bore is defined by a set of "lands" (the protruding areas between the grooves). While the lands are often thought of as having considerably ore surface area than the grooves, this is not always the case. In fact, many modern rifled bores have more groove area than land area.

Rifling ring 26 includes one or more groove engaging protrusions which have a diameter greater than the land diameter of the rifled bore. The rifling ring also includes lip receiver 88, which is configured to receive lip 80 on case 12 in a snap-fit configuration.

Aft closure 84 preferably includes aft pocket 86, which serves several functions. Turning briefly back to FIG. 9, the reader will observe that including the aft pocket increases the volume of low pressure chamber 20. Increasing this volume tends to spread the recoil impulse over a longer time interval—which decreases the weapon "kick" perceived by the shooter. The presence of the aft pocket also provides space to include a "base bleed" (the reader may wish to review U.S. Pat. No. 7,802,520 to Van Stratum (2010), which is hereby expressly incorporated by reference) gas generator (a device which injects gas behind the projectile in flight in order to reduce base drag) or a tracer (a source of bright light in the back of the projectile which allows the shooter to more accurately observe the trajectory).

Figure 12:
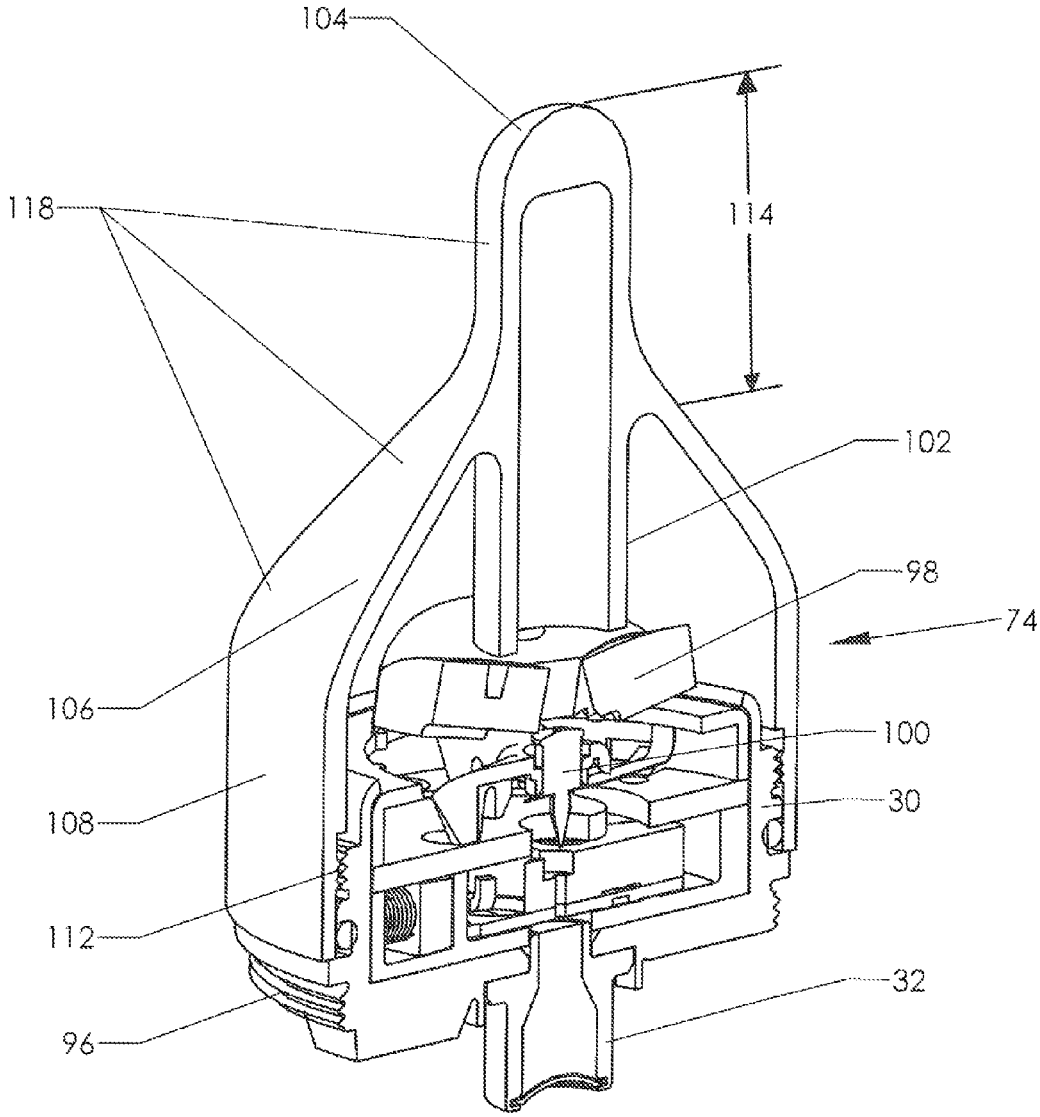
FIG. 12 is a perspective view with a cutaway, showing the ogive with an attached fuse assembly.

FIG. 12 shows detonation assembly 74 in detail. A cutaway is again provided. The detonation assembly has two main components—fuse assembly 30 and standoff ogive 118. These two components are joined together by any conventional means—with threaded engagement 112 being one example.

Spitback detonator 32 is attached to the aft end of fuse assembly 30. The fuse assembly is in reality a complex mechanism which is only represented in a conceptual form in FIG. 12, striker 100 is an element which activates the detonation sequence. It is akin to the firing pin in a rifle. The striker may include additional features such as a hammer weight or weights 98. While the striker may assume many forms, it is configured to activate the fuse assembly when it receives an impact load directed toward the rear of the projectile.

The fuse assembly typically contains a set-back safety device and a rotation safety device. Both these safety devices must be in the "fire" position in order for the striker to produce the detonation of spitback detonator 32. The set-back safety device must receive a sharp acceleration in the forward direction in order to switch from a "safe" configuration to a "fire" configuration. This occurs when the projectile is fired from the rifled bore.

The rotation safety device is switched from a "safe" position to a "fire" position when the projectile rapidly rotates through a defined number of rotations. This occurs when the rifling in the bore of the launching weapon rotationally accelerates the projectile to the spin rate it will experience in flight. The rotation safety device generally requires multiple rotations so that the weapon will have an "arming distance"—meaning that the fuse assembly cannot be fired until it has traveled a specific distance.

For prior art rounds, the arming distance is generally 14 m to 28 m. This requirement means that the safety devices are set so that no specific round out of a large sample will be armed before it has traveled 14 m and every specific round out of a large sample will be armed after it has traveled 28 m. Once the safety mechanisms are armed (in the "fire" position) a blow to striker 100 will actuate the fuse assembly. Spitback detonator 32 will then be fired and the explosive within the projectile will be initiated.

Standoff ogive 118 includes nose cap 104. The forward tip of the nose cap extends a significant distance beyond what would be the tip of a conventional ogive. This distance is denoted as extension 114.

The outer wall of standoff ogive 118 has three distinct regions in the particular embodiment shown. Cylindrical side wall 108 exists in the aft region. The thicker wall of nose cap 104 exists in the forward region. Sloping side wall 106 joins these two regions together into a unified whole. Of course, the separate regions may be formed by multiple independent parts linked together. In the embodiment shown, however, the three regions are formed as one integral piece.

A significant design feature of the present invention is the rapid transmission of impact forces experienced by nose cap 104 to striker 100. Thrust column 102 is provided for this purpose. While the thrust column may assume many geometric forms, it is important that it be relatively stiff.

In the embodiment shown, the thrust column is a hollow cylinder that is integrally molded with the balance of the standoff ogive. Graphite reinforced NYLON may be used for the standoff ogive and this provides sufficient stiffness. In other embodiments, a relatively soft material could be used for the nose cap and side walls, with a stiff metal cylinder being used for thrust column 102. Whatever configuration is used, the forward portion of the thrust column is connected to the nose cap while the aft portion rests against striker 100. Since the striker in the embodiment of FIG. 12 includes one or more hammer weights 98, the aft portion of thrust column 102 bears against these hammer weights.

In the embodiments shown, body 76 is joined to detonation assembly 74 by engaging male thread 96 (on the aft end of fuse assembly 30) and female thread 90 on the forward end of body 76. Uniting these two subassemblies creates a projectile. The projectile must be joined to the propulsion assembly so that they remain an integral unit up until the time when the grenade round is fired.

It is preferable to mold standoff ogive 118, body 76, and case 12 as plastic components. The use of plastic allows novel joining techniques. The reader will recall from FIG. 10 that side wall 17 of case 12 includes lip 80. From FIG. 11, the reader will also recall that rifling ring 26 includes lip receiver 88. These features allow the projectile assembly to "snap" into the open mouth of case 12—thereby uniting the propulsion assembly with the projectile.

Figure 13:
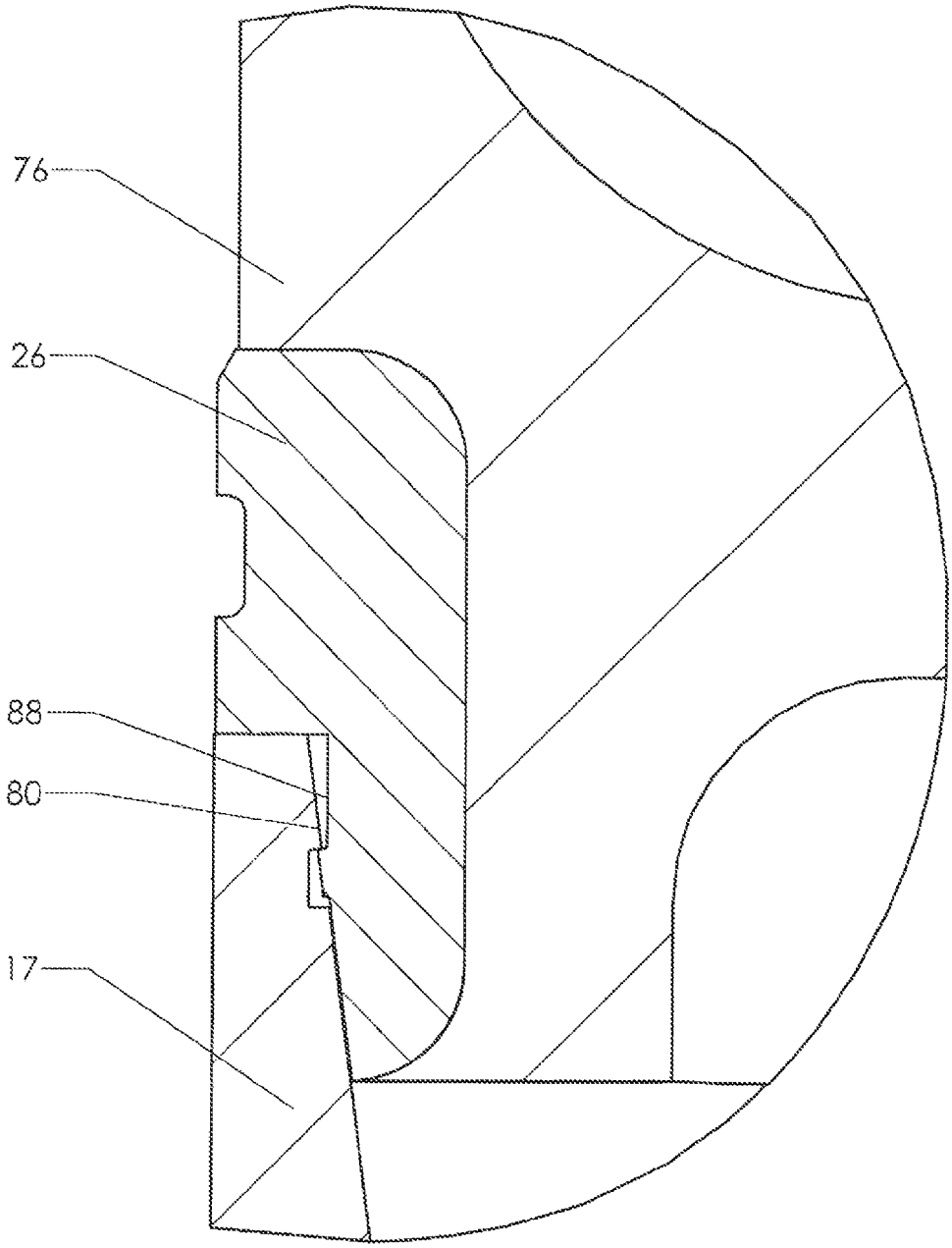
FIG. 13 is a section view, showing one embodiment of a snap fit between the propulsion assembly and the body.

FIG. 13 shows a sectioned elevation view of this snap engagement. As body 76 is forced downward (with respect to the orientation shown in the view) Lip 80 on side wall 17 will snap into lip receiver 88. This snap engagement will hold the components together until the weapon is fired. Other joining features could certainly be substituted, but a snap feature is inexpensive to produce and easy to use in the assembly process.

Figure 14:
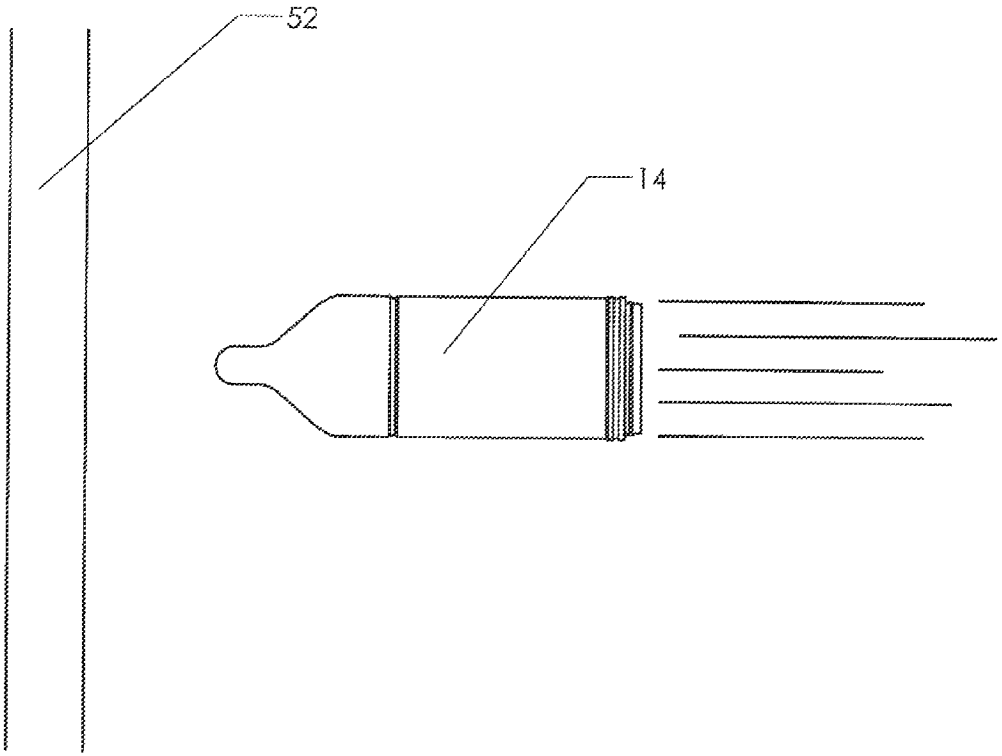
FIG. 14 is an elevation view, showing the projectile flying toward a door.

FIGS. 14-17 illustrate the operation of the present invention. FIG. 14 shows projectile 14 flying toward door 52. The nose cap of the standoff ogive extends well forward of the body. The nose cap strikes the target first and transmits the striking force back through the thrust column directly to the striker of the fuse assembly. The fuse assembly is thus struck while the body of the projectile (and the explosive it contains) is still well outside the door.

Figure 15:
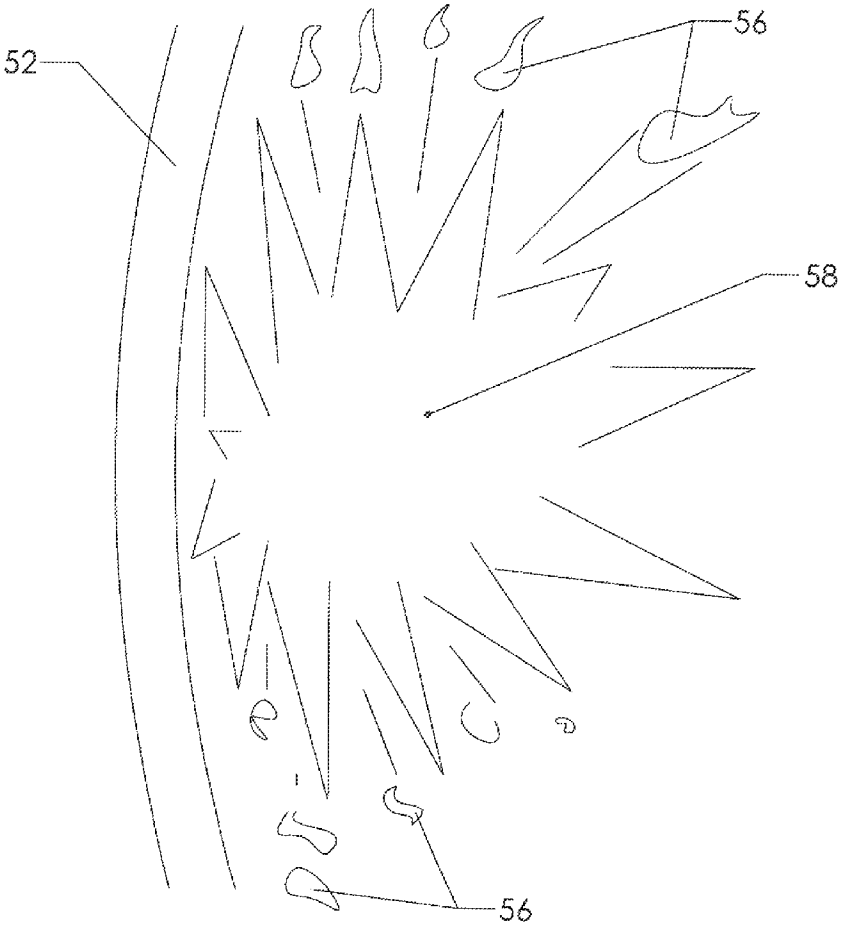
FIG. 15 is an elevation view, showing the detonation of the projectile.

FIG. 15 shows the detonation of the projectile. Explosion 58 shatters the body and other components of the projectile—creating flying debris 56. A strong pressure wave is projected forward toward door 52—which causes it to bow inward as shown.

Figure 16:
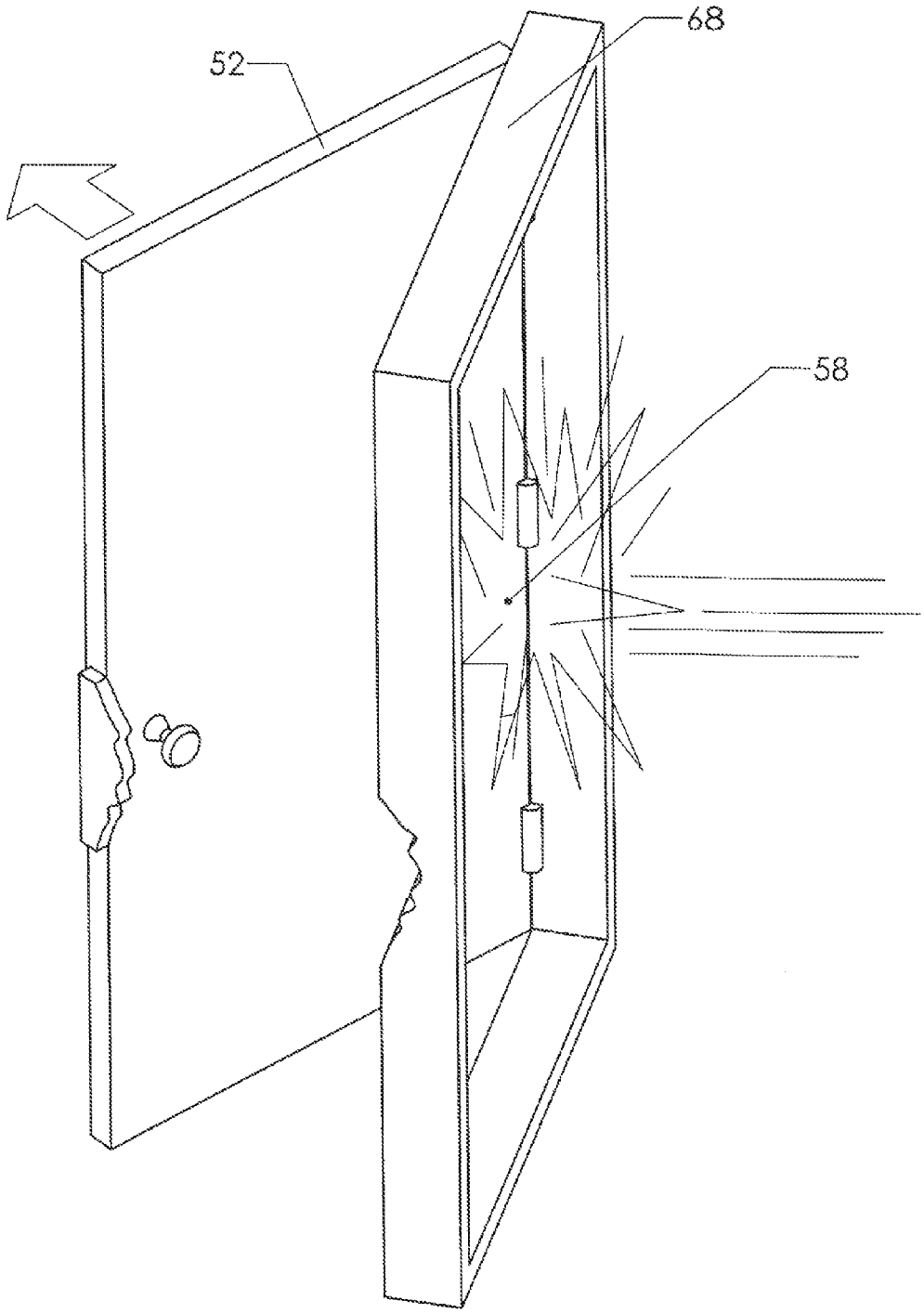
FIG. 16 is a perspective view, showing a door being blown open by the present invention.

FIG. 16 depicts the effect on a door in a perspective view. The pressure wave breaks the portion of door frame 68 containing the striker assembly, which allows the door to swing inward as shown.

Figure 17:
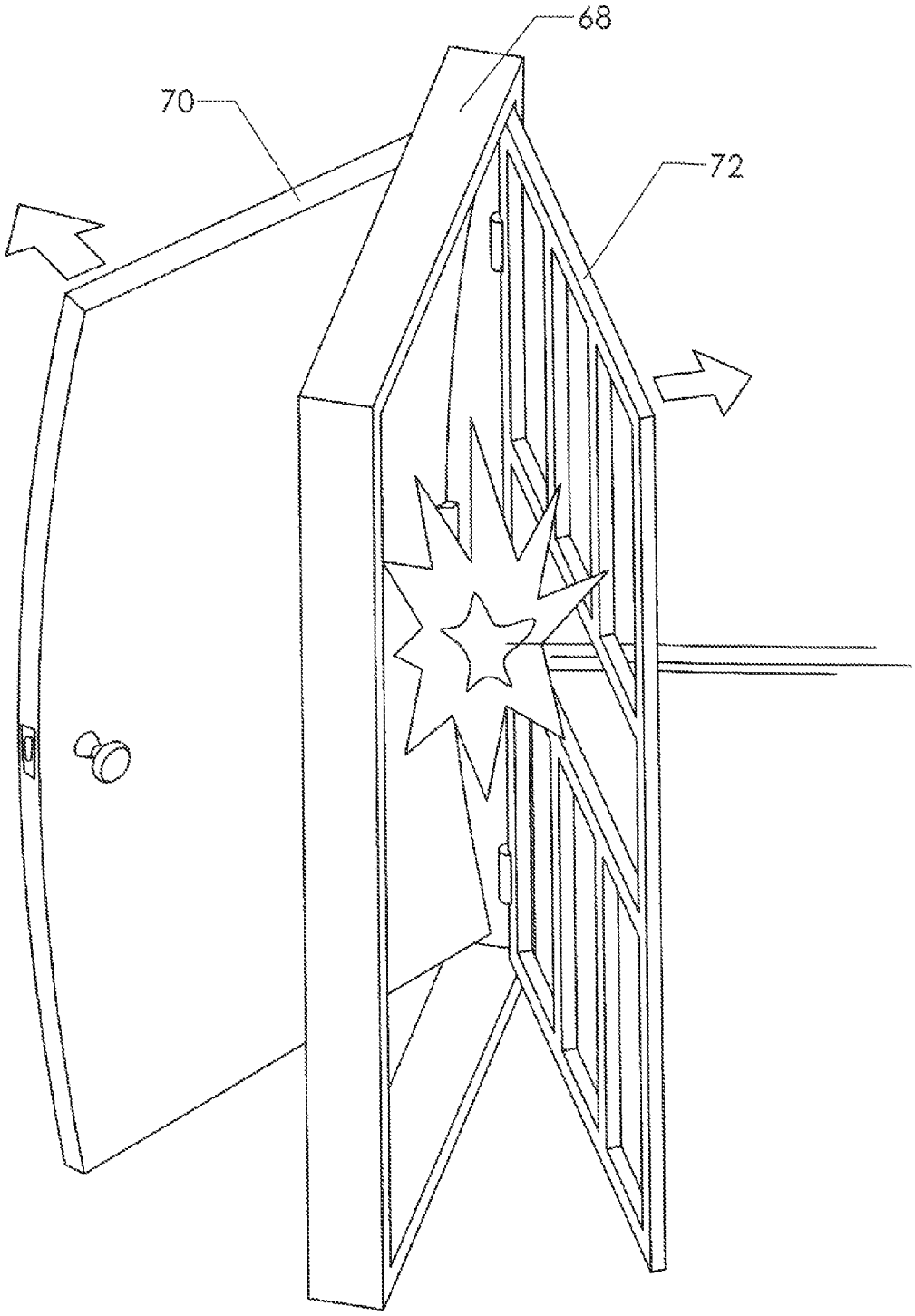
FIG. 17 is a perspective view, showing a steel door being blown open by the present invention.

FIG. 17 depicts the effect on a different type of door. Steel door 70 opens inward in this assembly while steel bar door 72 opens outward. The operation of the standoff ogive causes the explosive to detonate between the two doors, blowing steel door 70 inward and steel bar door 72 outward. A steel door frame typically will not break. However, the pressure wave impacting the steed door will deform it sufficiently to disengage the bolt with the striker and blow it open.

Material selection is significant to the advantages provided by the present invention. Returning now to FIGS. 9-12, some of these features will be explained. Case 12 of propulsion assembly 13 is preferably molded from glass reinforced NYLON. Cylindrical side wall 82 and aft closure 84 of body 76 are preferably molded of graphite reinforced NYLON. Standoff ogive 118 is also preferably molded of graphite reinforced NYLON (a very tough material).

Looking specifically at FIG. 9, the reader will observe that explosive 34 is surrounded by body 76 and the fuse assembly of detonation assembly 74. It is important to prevent electrical potential from building between components in contact with the explosive, as an electrical discharge could produce an accidental detonation.

In the prior art, the components surrounding the explosive tend to be conductive metal. In the present invention, however, the components tend to be non-conductive plastics. One way to resolve this problem is to coat the graphite reinforcing fibers in the plastic with conductive nickel. Another approach is to apply a thin conductive layer (such as deposited nickel) to the interior surface of the plastic components. Either approach provides sufficient conductivity to eliminate the problem of electrostatic discharges.

The use of plastic components throughout the projectile greatly reduces the production of harmful shrapnel upon detonation. The metal components of the fuse assembly tend to fly forward toward the door, where they are broken into even smaller particles. The metal of the rifling ring breaks into aluminum fragments having high surface area and low mass. These decelerate rapidly. The remaining plastic fragments are very small and produce little damage. As a result, a soldier firing the breaching projectile at a door may stand as close as 10 m. The arming range of the fuse assembly should be adjusted to 9-14 m (as opposed to 14-28 m for the prior art).

The use of plastic components in combination with appropriate geometry also serves to reduce "balloting" as the projectile accelerates down the bore and out the muzzle. "Balloting" refers to a precessing yaw of a projectile's centerline as it travels down the bore and exits the muzzle.

Ideally, the projectile's centerline remains perfectly concentric with the centerline of the rifled bore. In prior art grenade rounds, only a portion of the projectile's external surface engages the bore of the firing weapon. A forward "bore riding" ring is usually provided along with an aft rifling engaging ring. Balloting could be largely eliminated by providing the projectile with a smooth cylindrical surface sized to closely slide within the land diameter of the rifled bore (the "bore diameter"). However, many grenade launching weapons use soft metal barrels (such as thin walled steel or aluminum tubing). A close sliding fit with a metal projectile will quickly wear out the bore in such weapons.

The present invention uses much softer plastic materials, however. Even a soft bore material can endure many firings of a soft plastic projectile without significant degradation. Geometry is preferably included to minimize balloting. FIG. 11 shows cylindrical side wall 82. This is sized to be a close sliding fit within the land diameter (while the groove engaging protrusions of rifling ring 26 are sized to fit within the groove diameter and be larger than the land diameter).

Turning now to FIG. 12, the reader will recall that standoff ogive 118 includes cylindrical side wall 108. This is also sized to be a close sliding fit within the land diameter. Thus, the projectile has cylindrical surfaces which closely ride the land diameter along most of its length. This prevents projectile balloting as the projectile travels down the bore and as it exits the muzzle.

The preceding description contains significant detail, but it should not be construed as limiting the scope of the invention but rather as providing illustrations of the preferred embodiments of the invention. As an example, the shape of the standoff's ogive's side wall could be modified while still providing the basis function of the present invention. Many other alterations will occur to those skilled in the art. Thus, the scope of the invention should be fixed by the following claims, rather than by the examples given.

We claim:

1. A grenade round particularly adapted for breaching a door, said grenade round configured to be launched from a rifled bore having lands, grooves, a land diameter, and a groove diameter, comprising:

a. a propulsion assembly;

b. a projectile attached to said propulsion assembly;

c. said projectile including a body and a detonation assembly;

d. said body containing explosive;

e. said detonation assembly including a standoff ogive, a fuse assembly, and a detonator;

f. said fuse assembly including a striker, with said striker being configured to set off said detonator when said striker is struck, and a hammer weight positioned to bear against said striker;

g. said standoff ogive including, i. a cylindrical side wall connected to said fuse assembly, ii. a nose cap extending forward of said fuse assembly, iii. a sloping side wall linking said cylindrical side wall of said standoff ogive to said nose cap of said standoff ogive, iv. a thrust column extending from said nose cap to said hammer weight, said thrust column being made of a stiff material so that an impact on said nose cap is immediately transmitted to said hammer weight;

h. said body including, i. a cylindrical side wall, ii. an aft closure;

i. said cylindrical side wall of said body and said aft closure of said body including an electrically conductive element; and j. said cylindrical side wall of said body is mechanically and electrically connected to said fuse assembly.

2. A grenade round as recited in claim 1, wherein said body comprises:

a. the aft closure that is integral to said cylindrical side wall;

b. said cylindrical side wall and said aft closure being made of plastic; and c. a rifling ring made of a soft metal.

3. A grenade round as recited in claim 2, wherein:

a. said cylindrical side wall of said body has a diameter sized to slide closely within said land diameter of said rifled bore; and b. said rifling ring has at least one groove engaging protrusion, with a diameter of said a least one groove engaging protrusion being larger than said land diameter of said rifled bore.

4. A grenade round as recited in claim 2, wherein said body further comprises:

a. said explosive lying within said cylindrical side wall and forward of said aft closure;

b. said explosive having a forward end; and c. a bulkhead lying over said forward end of said explosive.

5. A grenade round as recited in claim 4, wherein said bulkhead includes a detonator pocket positioned to surround said detonator in said detonation assembly.

6. A grenade round as recited in claim 1, wherein said projectile is attached to said propulsion assembly by a snap fit.

7. A grenade round as recited in claim 1, wherein said electrically conductive element in said cylindrical side wall and said aft closure is selected from the group consisting of a metallic coating and a plurality of embedded conductive fibers.

8. A grenade round as recited in claim 1, wherein said thrust column is a cylindrical wall extending from said nose cap to said hammer weight.

9. A grenade round as recited in claim 1, wherein said standoff ogive is formed as one integral piece of reinforced plastic.

10. A grenade round particularly adapted for breaching a door, comprising:

a. a propulsion assembly;

b. a projectile mated to said propulsion assembly;

c. said projectile including a body and a detonation assembly;

d. said body containing explosive;

e. said detonation assembly including a standoff ogive, a fuse assembly, and a detonator;

f. said fuse assembly including a striker, with said striker being configured to set off said detonator when said striker is struck;

g. said standoff ogive including, i. a side wall, ii. a nose cap extending forward of said side wall, iii. a thrust column extending from said nose cap to said striker in said fuse assembly, said thrust column being made of a stiff material so that an impact on said nose cap is immediately transmitted to said striker;

h. said body including, i. a cylindrical side wall, ii. an aft closure;

i. said cylindrical side wall of said body and said aft closure of said body including an electrically conductive element; and j. said cylindrical side wall of said body is mechanically and electrically connected to said fuse assembly.

11. A grenade round as recited in claim 10, wherein said body comprises:

a. the aft closure that is integral to said cylindrical side wall;

b. said cylindrical side wall and said aft closure being made of plastic; and c. a rifling ring made of a soft metal.

12. A grenade round as recited in claim 11, wherein:

a. said cylindrical side wall of said body has a diameter sized to slide closely within said land diameter of said rifled bore; and b. said rifling ring has at least one groove engaging protrusion, with a diameter of said at least one groove engaging protrusion being larger than said land diameter of said rifled bore.

13. A grenade round as recited in claim 11, wherein said body further comprises:

a. said explosive lying within said cylindrical side wall and forward of said aft closure;

b. said explosive having a forward end; and c. a bulkhead lying over said forward end of said explosive.

14. A grenade round as recited in claim 13, wherein said bulkhead includes a detonator pocket positioned to surround said detonator in said detonation assembly.

15. A grenade round as recited in claim 10, wherein said projectile is attached to said propulsion assembly by a snap fit.

16. A grenade round as recited in claim 10, wherein said electrically conductive element in said cylindrical side wall and said aft closure is selected from the group consisting of a metallic coating and a plurality of embedded conductive fibers.

17. A grenade round as recited in claim 10, wherein said thrust column is a cylindrical wall extending from said nose cap to said striker.

18. A grenade round as recited in claim 10, wherein said standoff ogive is formed as one integral piece of reinforced plastic.

* * * * *